US012708228B2

(12) United States Patent
Walsh et al.

(10) Patent No.: US 12,708,228 B2
(45) **Date of Patent: *Aug. 18, 2026**

(54) TROPHY DEVICE AND METHOD OF MAKING THE SAME

(71) Applicant: TrophySmack, Inc., Orange, CA (US)

(72) Inventors: Matthew Walsh, Orange, CA (US); Dax Holt, Anaheim, CA (US); Eugene Yesin, Laguna Hills, CA (US)

(73) Assignee: TrophySmack, Inc., Orange, CA (US)

( * ) Notice: Subject to any disclaimer, the term of this patent is extended or adjusted under 35 U.S.C. 154(b) by 186 days.

This patent is subject to a terminal disclaimer.

(21) Appl. No.: 18/582,081

(22) Filed: Feb. 20, 2024

(65) Prior Publication Data

US 2024/0188743 A1 Jun. 13, 2024

Related U.S. Application Data

(63) Continuation of application No. 16/986,096, filed on Aug. 5, 2020, now Pat. No. 11,937,722.

(60) Provisional application No. 62/988,837, filed on Mar. 12, 2020.

(51) Int. Cl.
*A47G 33/00* (2006.01)

(52) U.S. Cl.
CPC ..... *A47G 33/004* (2013.01)

(58) Field of Classification Search
CPC ..... A47G 33/004
See application file for complete search history.

(56) References Cited

U.S. PATENT DOCUMENTS

| | | | |
|---|---|---|---|
| D11,364 | S | 8/1879 | Pool et al. |
| D92,400 | S | 6/1934 | Hoeflich |
| 2,634,934 | A | 4/1953 | Martin et al. |
| 4,202,241 | A | 5/1980 | Lucas |
| D255,441 | S | 6/1980 | Allgood, II |
| D267,636 | S | 1/1983 | Allgood, II |
| D295,269 | S | 4/1988 | Allgood, II |
| D296,309 | S | 6/1988 | Allgood, II |
| 5,365,683 | A | 11/1994 | Borja |
| D394,231 | S | 5/1998 | Pierce |
| D395,122 | S | 6/1998 | Dunlop |
| D815,979 | S | 4/2018 | Odigie |
| 10,442,140 | B2 | 10/2019 | Surber |
| D956,478 | S | 7/2022 | Shi |
| D962,000 | S | 8/2022 | Bi |
| 2002/0053154 | A1 | 5/2002 | Stephan |
| 2003/0082316 | A1 | 5/2003 | Scott |
| 2016/0242405 | A1 | 8/2016 | Zhang et al. |

OTHER PUBLICATIONS

TrophySmack, "Fantasy Football Greatness", 2017; Accessed at https://web.archive.org/web/20180104095543/https://www.trophysmack.com.

Marco Awards Group Master Catalog, 2009; Accessed at http://www.carolinatrophies.com/PDF/DTC%202009%20Master%20Catalog.pdf.

*Primary Examiner* — Humera N. Sheikh
*Assistant Examiner* — Julia L Rummel
(74) *Attorney, Agent, or Firm* — Master Key IP, LLP; Justin G. Sanders

(57) ABSTRACT

A trophy apparatus, comprising, in at least one embodiment, a plurality of columns; a base piece comprising a plurality of grooves, each configured to attach to a bottom end of each of the plurality of columns, and further comprising an interface configured to couple to a plaque mount; and a lid piece comprising a plurality of grooves, each configured to attach to a top end of each of the plurality of columns.

17 Claims, 15 Drawing Sheets

TROPHY DEVICE AND METHOD OF MAKING THE SAME

RELATED APPLICATIONS

This is a continuation application and so claims the benefit pursuant to 35 U.S.C. § 120 of a prior filed and U.S. non-provisional patent application Ser. No. 16/986,096, filed on Aug. 5, 2020, which itself claims priority pursuant to 35 U.S.C. § 119(e) to and is entitled to the filing date of U.S. provisional patent application Ser. No. 62/988,837, filed on Mar. 12, 2020. The contents of the aforementioned applications are incorporated herein by reference.

BACKGROUND

The subject of this patent application relates generally to a novel trophy device and method of making the same.

Applicant hereby incorporates herein by reference any and all patents and published patent applications cited or referred to in this application.

By way of background, the current state of the art for trophies involve parts such as rods, plastic columns, and couplers, which when assembling the same requires one to assemble it in an upside-down fashion. Such assembly also requires a balancing act to fit the parts together, including the lid of the columns, the rods, nuts, and/or base of the trophy, typically by hand or manual assembly. For larger sized trophies, parts such as couplers must be used in order to connect two or more rods together so as to extend the rods' length for attachment to the lid and base of the trophy.

Further, such assembly requires one to align the columns of the trophy by 'free hand' or 'eyeballing,' which creates difficulty in ensuring that each column is straight in addition to being adequately secured by tightening of the nuts. Since such trophies' columns are typically held in place solely by the tightness of the nuts, the columns can easily shift around, including during handling and shipping of the trophies to customers. Typically, plaques are attached to the trophy using mounting tape or screws which make it cumbersome or ineffective to change a plaque.

The proposed device and method for a trophy device and method of making the same allows for substantial efficiency in assembly of the trophy as well as significant durability and stability of the assembled trophy, including during shipment of the trophy to customers. Furthermore, the present invention allows for interchangeability of the trophy's plaque piece via a unique track system.

Aspects of the present invention fulfill these needs and provide further related advantages as described in the following summary.

It should be noted that the above background description includes information that may be useful in understanding aspects of the present invention. It is not an admission that any of the information provided herein is prior art or relevant to the presently claimed invention, or that any publication specifically or implicitly referenced is prior art.

SUMMARY

Aspects of the present invention teach certain benefits in construction and use which give rise to the exemplary advantages described below.

The present invention solves the problems described above by providing a trophy apparatus and a method of making the same. In at least one embodiment, the apparatus comprises a plurality of columns; a base piece comprising a plurality of grooves, each configured to attach to a bottom end of each of the plurality of columns, and further comprising an interface configured to couple to a plaque mount; and a lid piece comprising a plurality of grooves, each configured to attach to a top end of each of the plurality of columns.

In at least one further embodiment, the apparatus comprises a plurality of cylindrical columns; a base piece having a plurality of grooves on a top side, each configured to attach to a bottom end of each of the plurality of columns; a lid piece having a plurality of grooves on a bottom side, each configured to attach to a top end of each of the plurality of columns; a plaque mount configured to removably attach to the base piece; and a plaque piece comprising a plurality of inner tracks on a rear side that are configured to slidably attach with a plurality of U-shaped prongs situated on a forward-facing side of the plaque mount.

In at least one embodiment, a method of making a trophy apparatus comprises the steps of forming a plurality of cylindrical columns; forming a base piece having a plurality of grooves on a top side, each configured to attach to a bottom end of each of the plurality of columns; forming a lid piece having a plurality of grooves on a bottom side, each configured to attach to a top end of each of the plurality of columns; forming a plaque mount configured to removably attach to the base piece and that comprises a plurality of U-shaped prongs situated on a forward-facing side of the plaque mount; and forming a plaque piece comprising a plurality of inner tracks on a rear side that are configured to slidably attach with the U-shaped prongs of the plaque mount.

Other features and advantages of aspects of the present invention will become apparent from the following more detailed description, taken in conjunction with the accompanying drawings, which illustrate, by way of example, the principles of aspects of the invention.

BRIEF DESCRIPTION OF THE DRAWINGS

The accompanying drawings illustrate aspects of the present invention. In such drawings.

The above described drawing figures illustrate aspects of the invention in at least one of its exemplary embodiments, which are further defined in detail in the following description. Features, elements, and aspects of the invention that are referenced by the same numerals in different figures represent the same, equivalent, or similar features, elements, or aspects, in accordance with one or more embodiments.

DETAILED DESCRIPTION

The detailed descriptions set forth below in connection with the appended drawings are intended as a description of embodiments of the invention and are not intended to represent the only forms in which the present invention may be constructed and/or utilized. The descriptions set forth the structure and the sequence of steps for constructing and operating the invention in connection with the illustrated embodiments. It is to be understood, however, that the same or equivalent structures and steps may be accomplished by different embodiments that are also intended to be encompassed within the spirit and scope of the invention.

Figure 1:
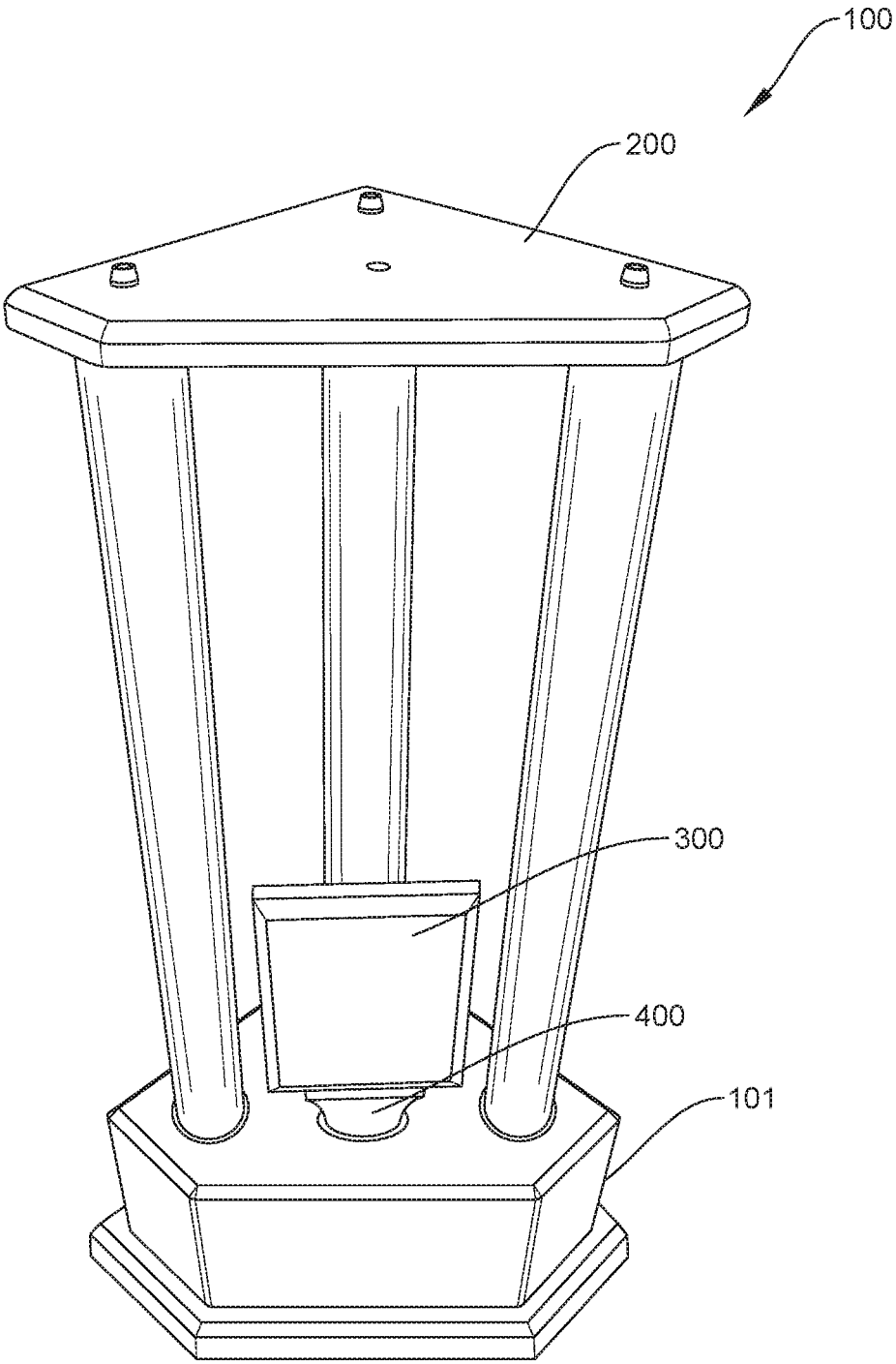
FIG. 1 is a perspective view of an exemplary trophy device, in accordance with at least one embodiment.

FIG. 1 illustrates a perspective view of a trophy device 100 in accordance with one embodiment. Trophy device 100 may comprise a base 101, one or more columns 50, a lid piece 200, a plaque 300, and a plaque mount 400. Trophy device 100 may be outfitted with one of more plaques 300 and plaque mounts 400 depending on customization requirements.

Figure 2A:
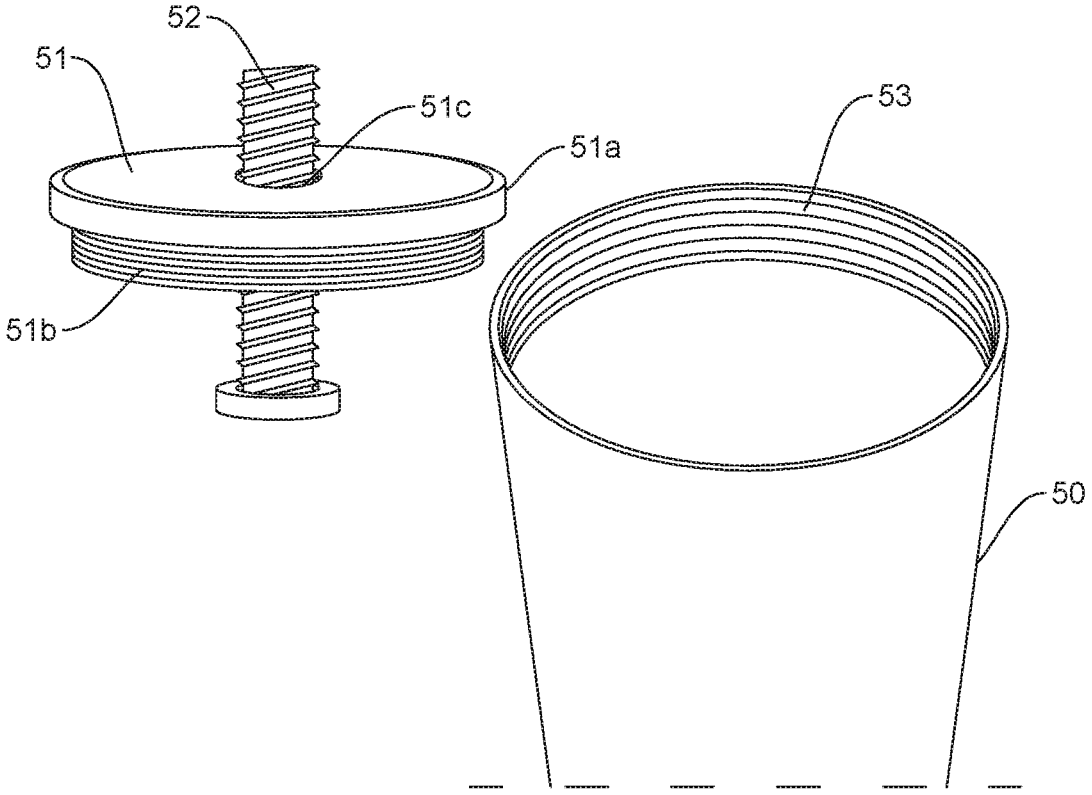
FIG. 2A illustrates a column cap with a bolt component and a bottom portion of a column, in accordance with at least one embodiment.
Figure 2B:
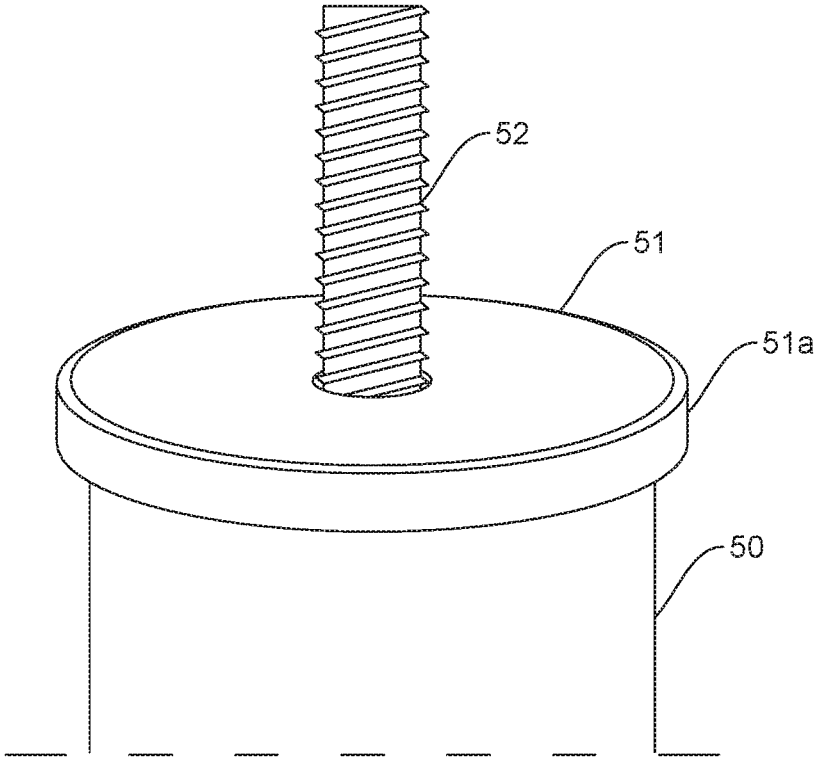
FIG. 2B illustrates the column cap with the bolt component coupled to the base of a column, in accordance with at least one embodiment.

FIG. 2A illustrates a column cap 51 and cap bolt 52 component that is configured to fit on a bottom end of column 50 that is configured to attach to base 101. FIG. 2B illustrates column cap 51 and cap bolt 52 component (shown coupled to a column groove 102 in FIG. 4A below) prefabricated on a top surface of base 101. Column cap 51 further comprises outer rim 51*a*, inner threaded rim 51*b*, and a bolt insertion point/interface 51*c*. Such outer rim 51*a* of column cap 51 may serve to reinforce the positioning and stability of column 50 when installed onto base 101. Bolt insertion point/interface 51*c* may be comprised of an opening in a center portion of cap 51 and which is threaded in configuration in order to allow for the coupling of bolt 52 therethrough. Each end of column 50 has an inner threaded rim 53 to allow for coupling to column cap 51 via the inner threaded rim 51*b* of column cap 51. FIG. 2B depicts how bolt 52 may be completely threaded through insertion point/interface 51*c* prior to coupling column cap 51 to column 50. In such case, bolt 52 is in a configuration so that column 50 can be attached to base 101. In the exemplary embodiment of trophy 100, columns 50 and column caps 51 are composed of a metal material, such as an anodized metal material. Use of a metal material allows for increased durability of trophy 100 and significantly decreases the likelihood of trophy 100 becoming disjointed, damaged, cracked, or offset during shipping and handling. Such durability of the metal materials also allows for trophy 100 to be shipped to a customer in a fully assembled form.

Figure 3A:
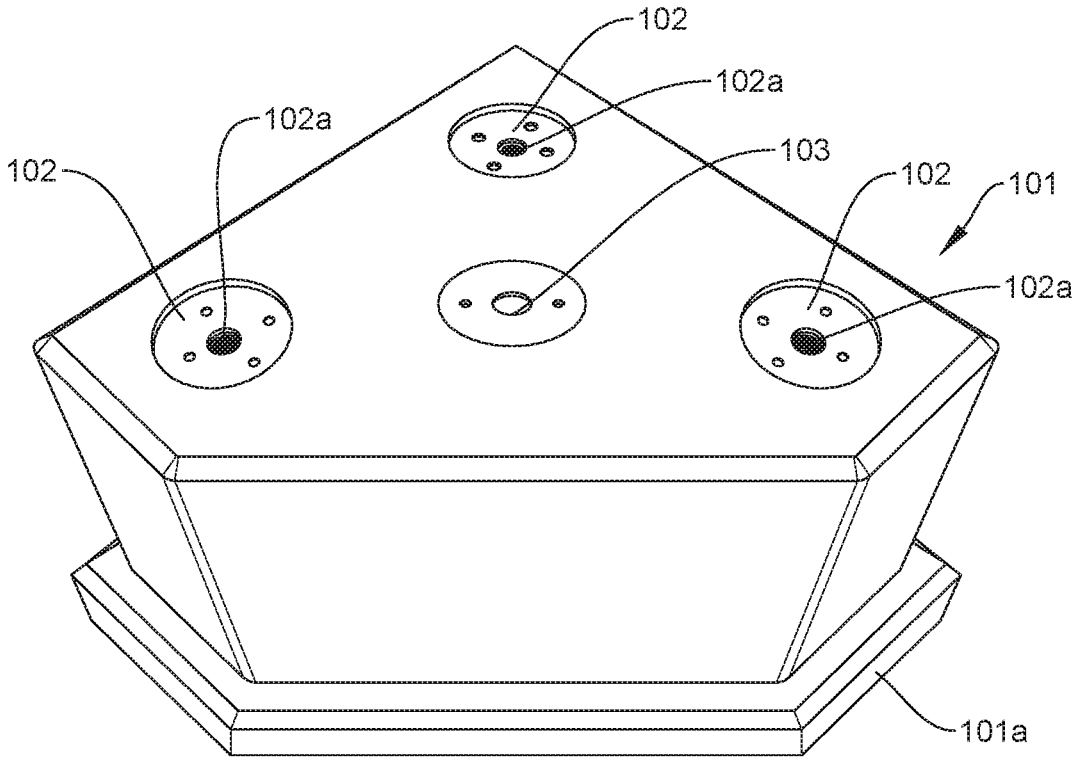
FIG. 3A illustrates a base component of the trophy device, in accordance with at least one embodiment.

FIG. 3A illustrates base 101 of the trophy device 100 without any column 50 or plaque 300 attachments. Base 101 may further comprise a base rim 101*a*, one or more column grooves 102, one or more insertion points/interfaces 102*a*, and a plaque mount insertion point/interface 103. Base 101 may be comprised of a wooden material and have a triangular shape in the exemplary embodiment. Base 101 may have a height of 5 to 7 inches in the exemplary embodiment so as to allow spacing for award or competition engraving pieces to be attached around the sides of base 101 as desired.

Column grooves 102 may be circular in shape, disc-shaped, and/or cylindrical shaped, as well as have a height that is equal or substantially equal to the height of column cap 51 in order to further secure column 50 within column groove 102. As referred to earlier with respect to FIG. 2B, bolt 52 is threaded within column cap 51 which may then be secured to base 101 by screwing it into insertion point/interface 102*a* (See FIG. 4A for further detail and depiction).

Figure 3B:
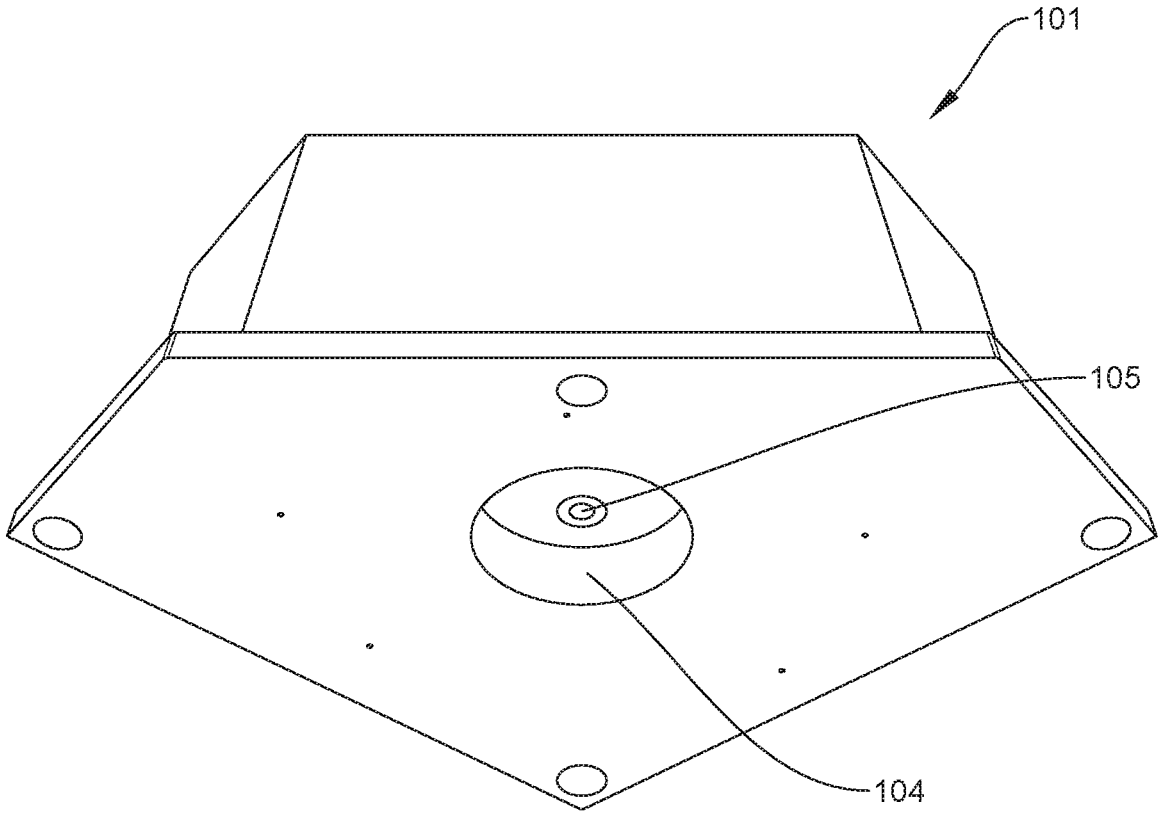
FIG. 3B illustrates the bottom perspective view of the base of the trophy device, in accordance with at least one embodiment.

The top surface of base 101 may be at least two inches in thickness so as to allow for the prefabrication of one or more column grooves 102 and for the secure attachment of one or more bolts 52 that are screwed (including vertically) into one or more insertion points/interfaces 102*a*. FIG. 3B illustrates a bottom perspective view of base 101 of trophy device 100. The bottom portion of base 101 may comprise a groove 104 which is circular in shape, and which may further comprise an insertion end point/interface 105 positioned in a center area of the circular shape of groove 104. Insertion end point/interface 105 may be utilized to further guide and secure plaque mount pin 403 in place (further discussed below).

Figure 4A:
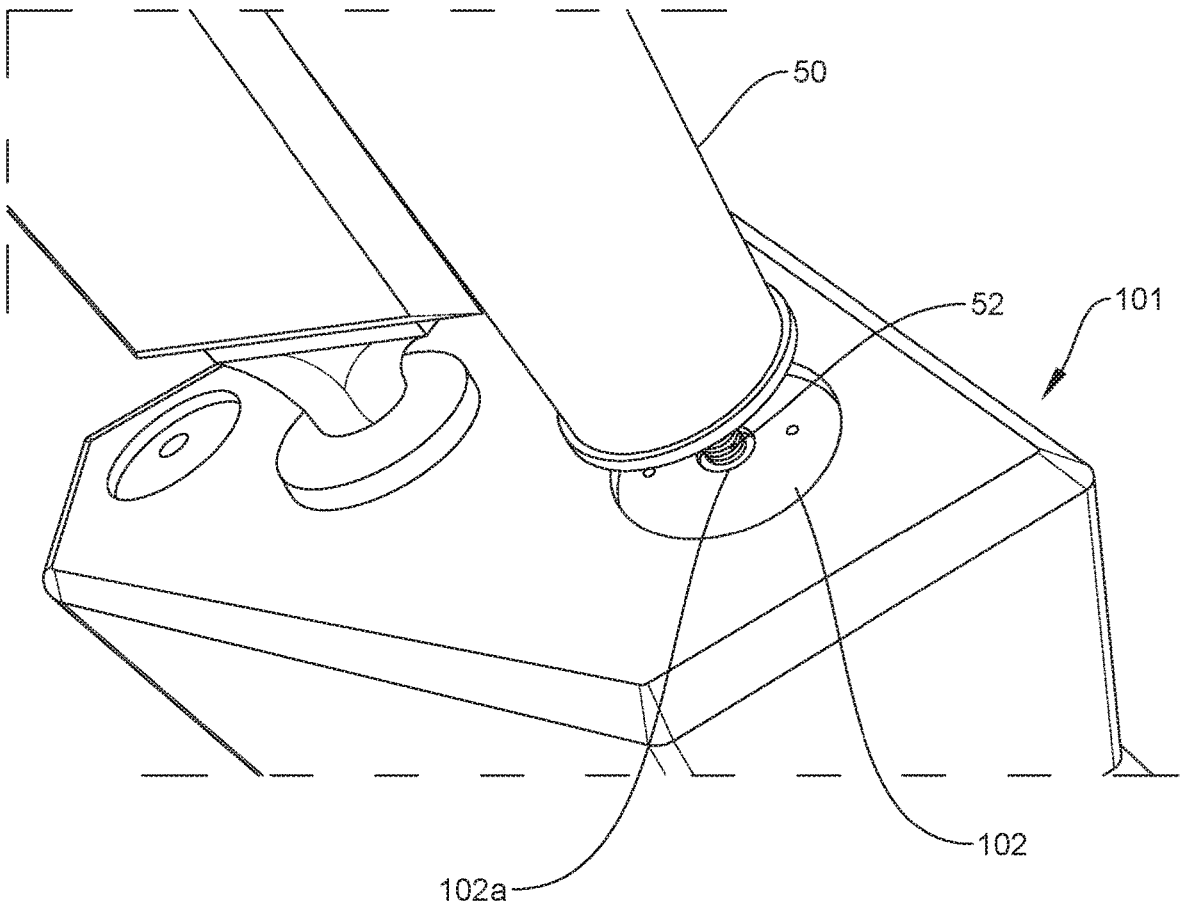
FIG. 4A illustrates a column component being coupled to the base piece of the trophy device, in accordance with at least one embodiment.
Figure 4B:
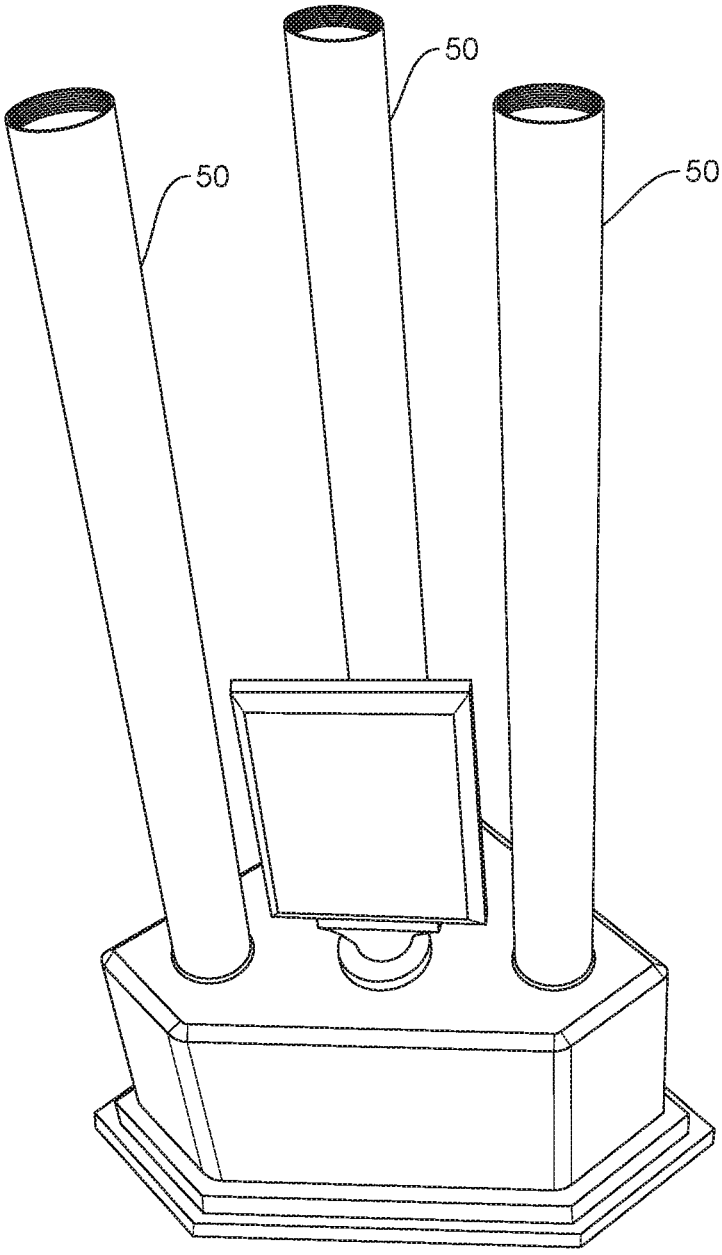
FIG. 4B illustrates a configuration of three columns coupled to the base piece of trophy device, in accordance with at least one embodiment.

FIG. 4A illustrates column 50 being attached to base 101 via bolt 52, which is already secured to column 50 via column cap 51. As base 101 may comprise one or more grooves 102 for placement of one or more columns 50, FIG. 4B illustrates a configuration where three columns 50 are coupled in a triangular configuration to base 101.

Figure 5A:
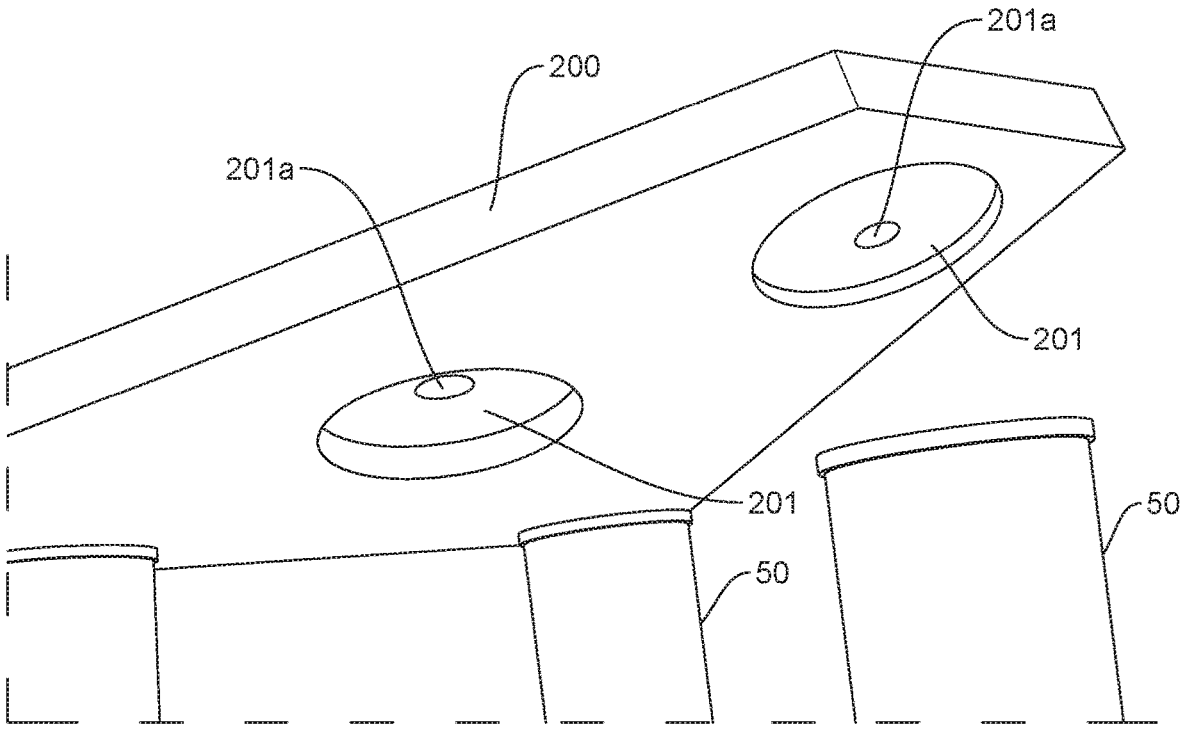
FIGS. 5A-5C illustrate a trophy lid piece being coupled to top ends of the three column pieces and fastened with a plurality of bolt devices, in accordance with at least one embodiment.
Figure 5B:
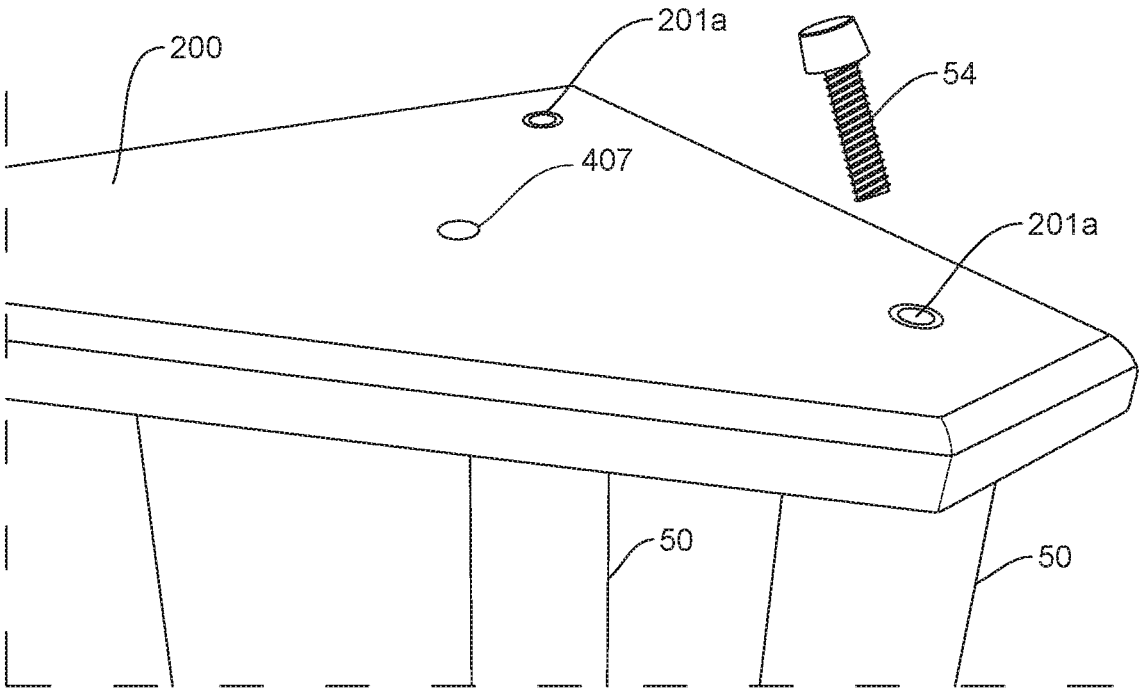
Figure 5C:
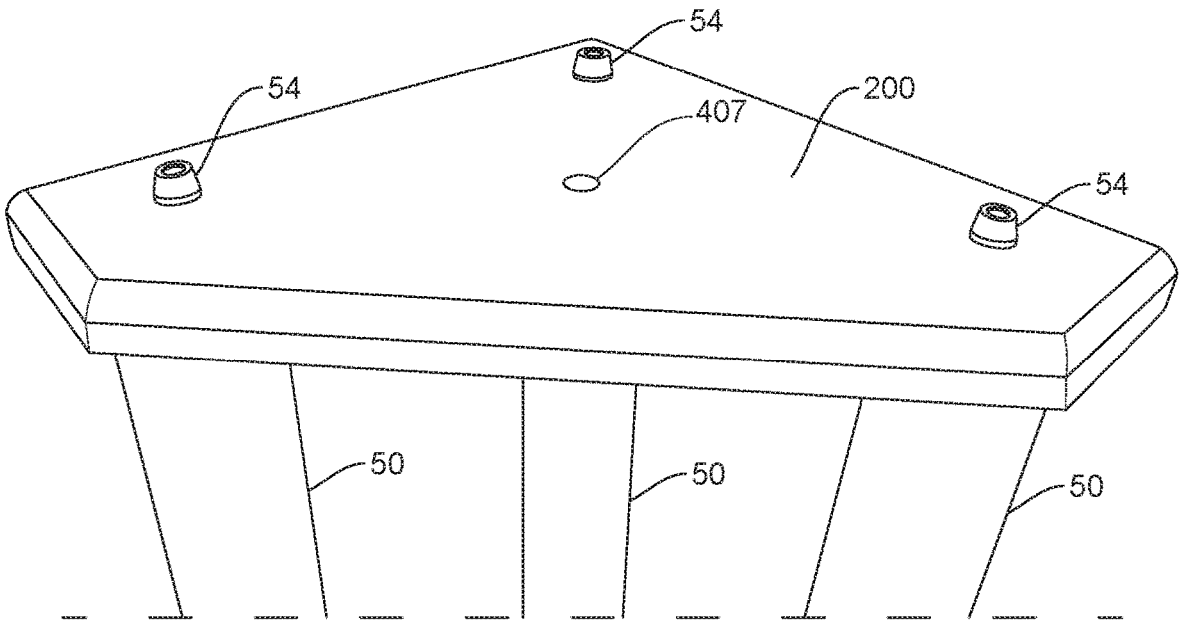

FIGS. 5A-C illustrate a trophy lid piece 200 being coupled to a plurality of top ends of columns 50 and further fastened to lid 200 via a plurality of conical bolts 54. Lid 200 may comprise one or more lid column grooves 201 that are circular in shape and configured to hold column cap 51 that is attached to a top end of column 50. In this configuration, lid column grooves 201 are prefabricated onto a bottom side of lid 200. Once each column cap 51 has been inserted into each lid column groove 201, conical bolts 54 are screwed into lid insertion points/interfaces 201*a* in order to further secure column cap 51 and column 50 to lid 200. Conical bolts 54 may comprise conical Allen bolts, although other similar bolts or fastening devices, such as other screws, pegs, or snaps may be utilized to further secure column caps 51 and column 50 to lid 200. Trophy lid 200 may also comprise a topper insertion point/interface 407 so that a topper (not shown), such as an ornamental football, soccer ball, or basketball, may be installed thereon as desired. Topper (not shown) may comprise a hexagonal female threaded insert at a center of its bottom portion to allow for a corresponding hexagonal shaped bolt (such as a 1 inch bolt) to be threaded through from below trophy lid 200 through topper insertion point/interface 407 and inserted into topper.

Figure 6A:
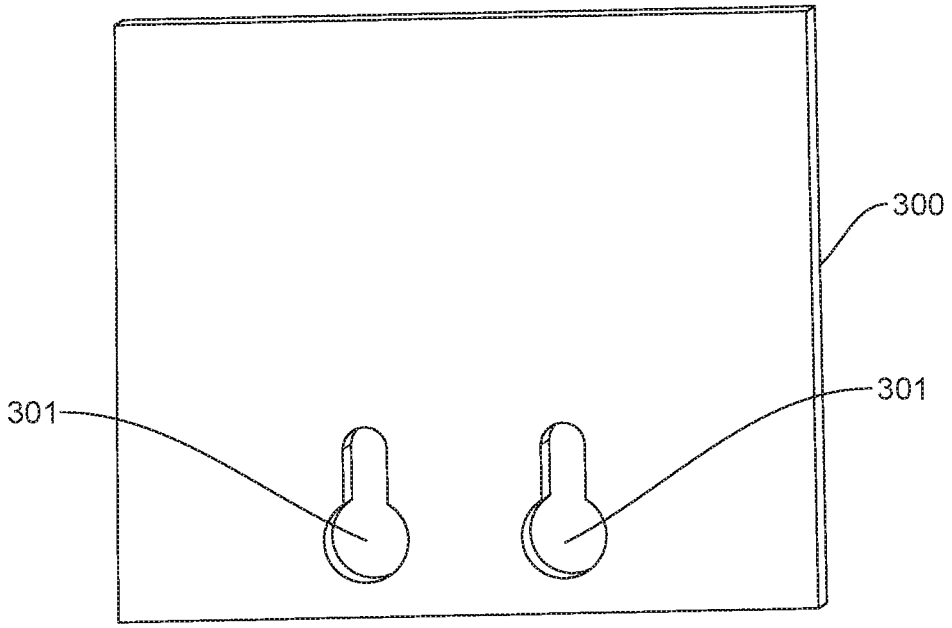
FIGS. 6A and 6B illustrate a plaque piece and plaque mount piece, in accordance with at least one embodiment.
Figure 6B:
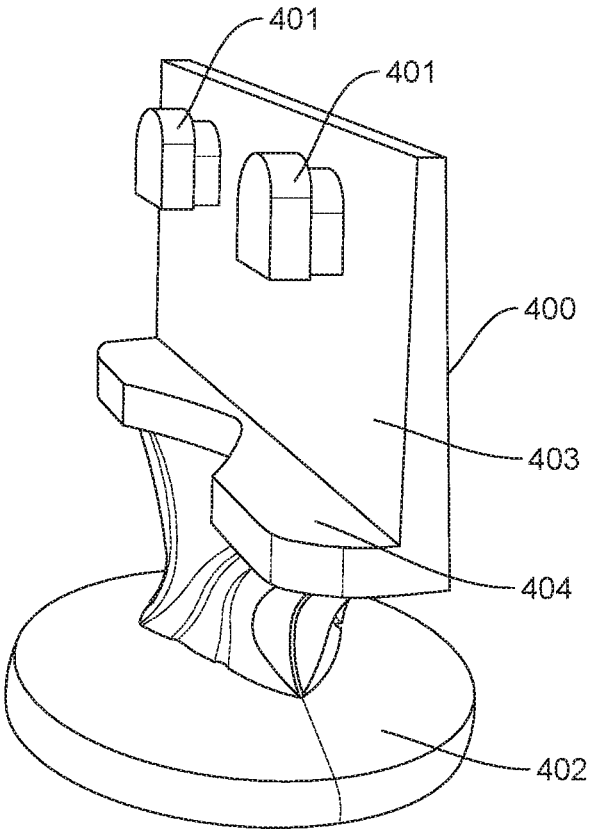

FIGS. 6A-B illustrate plaque 300 and plaque mount 400 that may be coupled together prior to attachment to base 101. Plaque 300 may comprise one or more inner tracks 301 that are inset therewithin and configured to receive and attach to one or more prongs 401 of plaque mount 400. One or more inner tracks 301 are prefabricated within a rear side of plaque 300, with their outer surface which may comprise a thermometer-like shape, or an inverted U-shape atop a circular or bulb shape and their inner surface within plaque 300 which may comprise rounded edges configured to receive and fit snugly around prongs 401. Prongs 401 may be positioned in a horizontally raised position off of an upper front facing side of plaque mount panel 403. Prongs 401 may be shaped as inverted three-dimensional U-shapes, positioned along a single horizontal axis, and spaced apart so that they are aligned to be able to be inserted evenly into tracks 301. However, prongs 401 may be formed from alternate shapes and dimensions without deviating from the scope of the present invention.

Figure 6C:
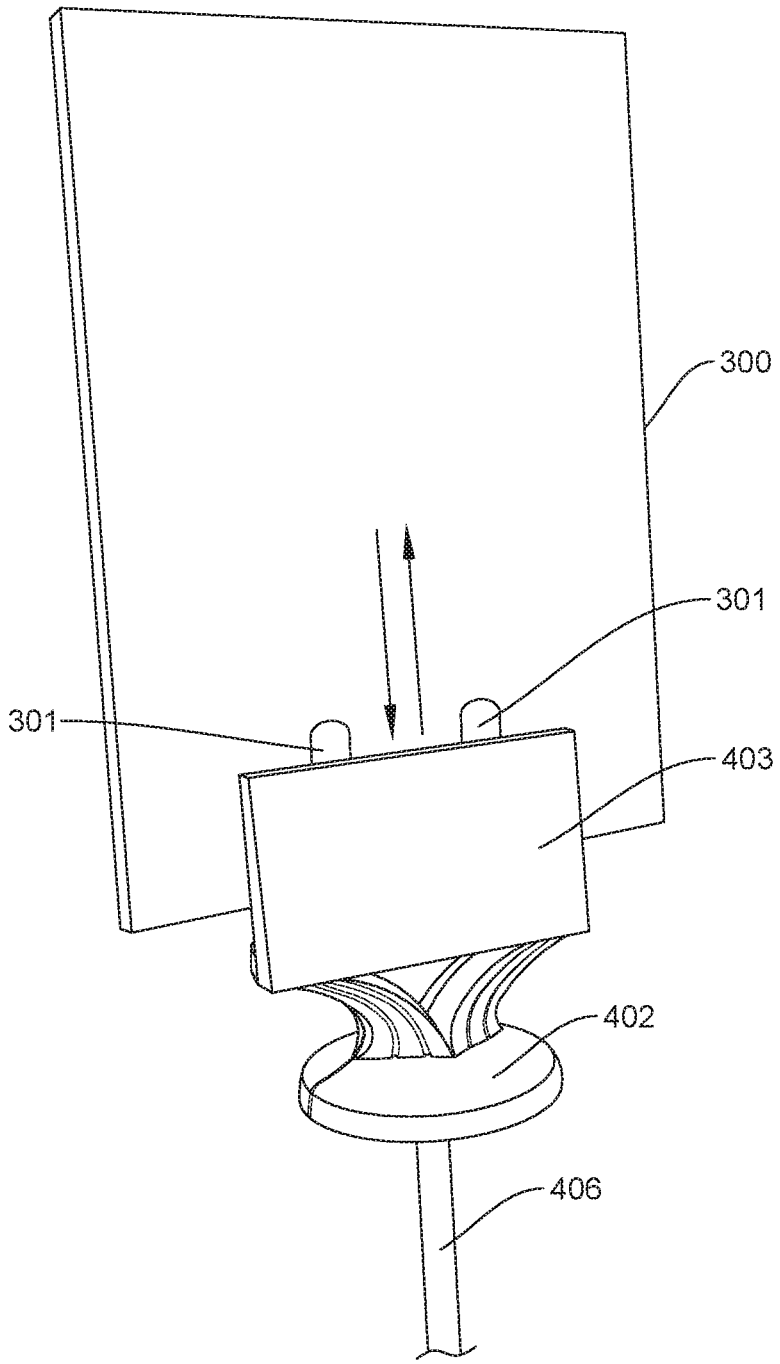
FIG. 6C illustrates the plaque and plaque mount pieces being coupled together, in accordance with at least one embodiment.
Figure 6D:
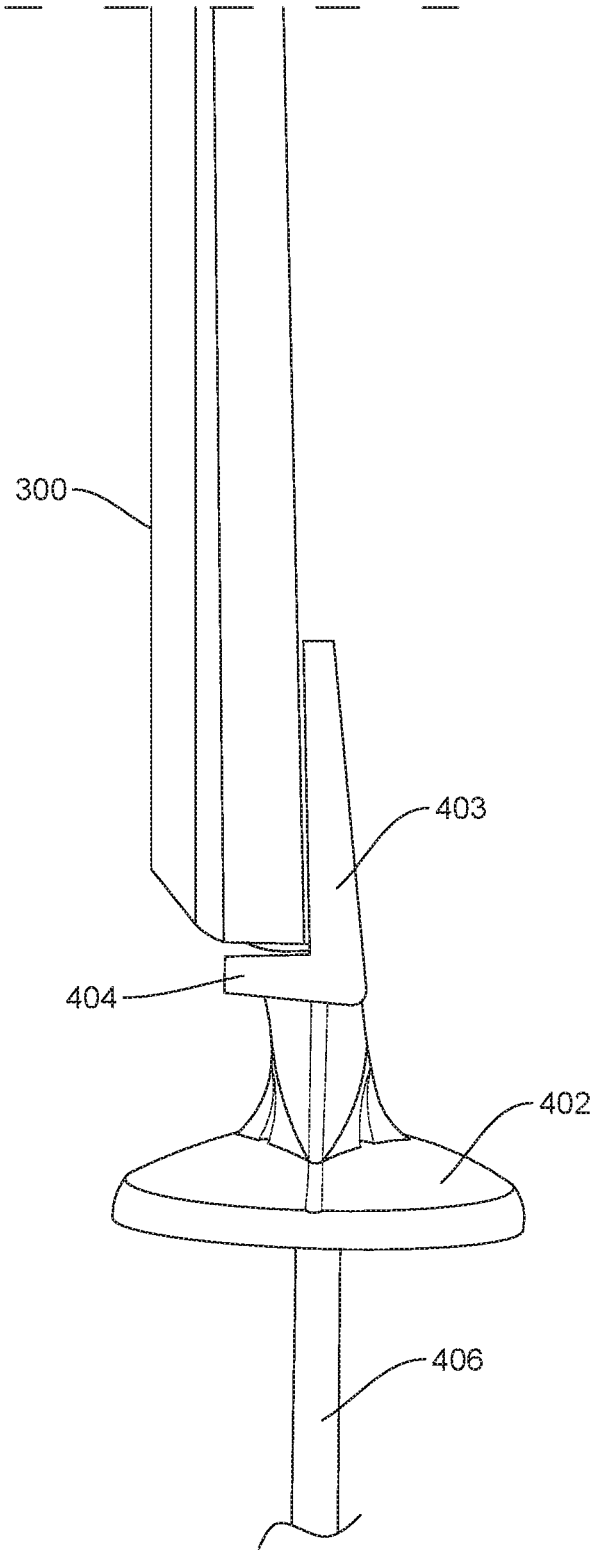
FIG. 6D illustrates a side view of the plaque and plaque mount pieces coupled together, in accordance with at least one embodiment.

FIG. 6C illustrates plaque 300 and plaque mount 400 being coupled together by inserting prongs 401 into the circular or bulb portion of tracks 301 and sliding prongs 401 in an upward fashion. FIG. 6D illustrates a side view of plaque 300 and plaque mount 400 attached together. Tracks 301 are slid down upon prongs 401 which are already inserted therein, until a bottom side of plaque 300 is substantially flush with plaque mount shelf 404.

Figure 7A:
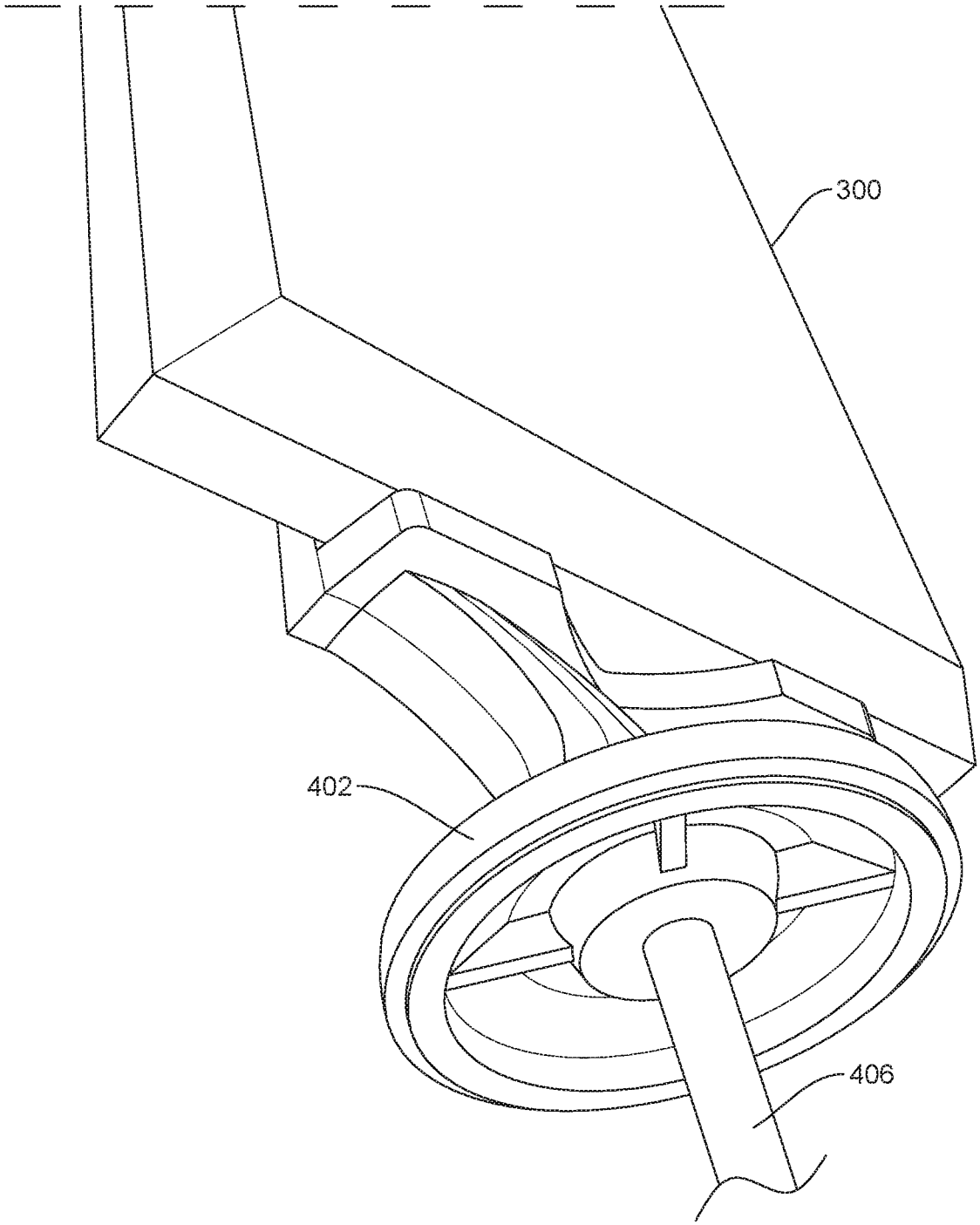
FIG. 7A illustrates a bottom view of the plaque mount piece, in accordance with at least one embodiment.
Figure 7B:
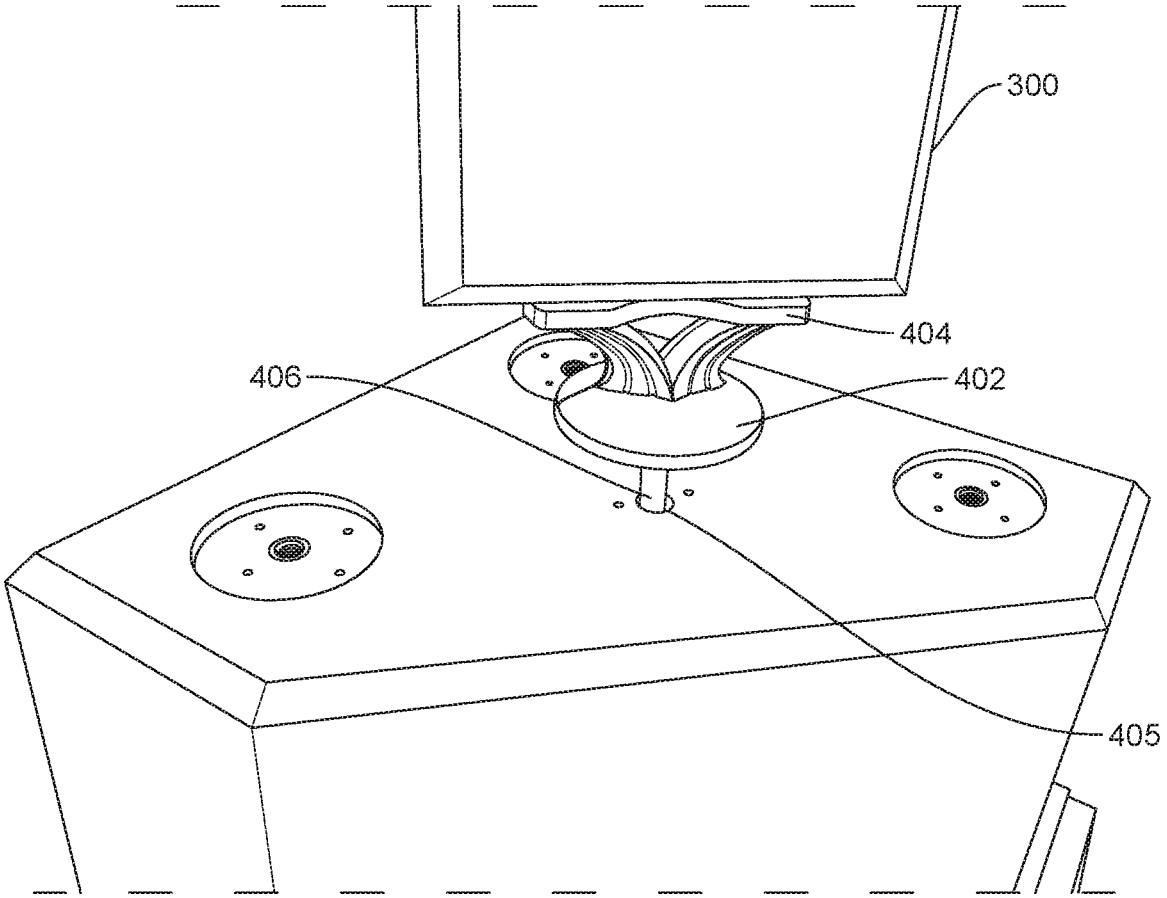
FIG. 7B illustrates the plaque and plaque mount pieces being coupled to the trophy base, in accordance with at least one embodiment.

FIG. 7A illustrates a bottom view of plaque mount base 402, which comprises plaque mount insertion point/interface 405. Insertion point/interface 405 and insertion end point/interface 105 may be configured to receive a plaque mount pin 406 through the body of base 101. FIG. 7B illustrates how plaque mount 400 is attached to base 101 via plaque mount pin 406.

In closing, regarding the exemplary embodiments of the present invention as shown and described herein, it will be appreciated that a novel trophy device and method of making the same is disclosed. Because the principles of the invention may be practiced in a number of configurations beyond those shown and described, it is to be understood that the invention is not in any way limited by the exemplary embodiments, but is generally directed to a trophy device and is able to take numerous forms to do so without departing from the spirit and scope of the invention. It will also be appreciated by those skilled in the art that the present invention is not limited to the particular geometries and materials of construction disclosed, but may instead entail other functionally comparable structures or materials, now known or later developed, without departing from the spirit and scope of the invention.

Certain embodiments of the present invention are described herein, including the best mode known to the inventor(s) for carrying out the invention. Of course, variations on these described embodiments will become apparent to those of ordinary skill in the art upon reading the foregoing description. The inventor(s) expect skilled artisans to employ such variations as appropriate, and the inventor(s) intend for the present invention to be practiced otherwise than specifically described herein. Accordingly, this invention includes all modifications and equivalents of the subject matter recited in the claims appended hereto as permitted by applicable law. Moreover, any combination of the above-described embodiments in all possible variations thereof is encompassed by the invention unless otherwise indicated herein or otherwise clearly contradicted by context.

Groupings of alternative embodiments, elements, or steps of the present invention are not to be construed as limitations. Each group member may be referred to and claimed individually or in any combination with other group members disclosed herein. It is anticipated that one or more members of a group may be included in, or deleted from, a group for reasons of convenience and/or patentability. When any such inclusion or deletion occurs, the specification is deemed to contain the group as modified thus fulfilling the written description of all Markush groups used in the appended claims.

Unless otherwise indicated, all numbers expressing a characteristic, item, quantity, parameter, property, term, and so forth used in the present specification and claims are to be understood as being modified in all instances by the terms "about" and "approximately." As used herein, the terms "about" and "approximately" mean that the characteristic, item, quantity, parameter, property, or term so qualified encompasses a range of plus or minus ten percent above and below the value of the stated characteristic, item, quantity, parameter, property, or term. Accordingly, unless indicated to the contrary, the numerical parameters set forth in the specification and attached claims are approximations that may vary. At the very least, and not as an attempt to limit the application of the doctrine of equivalents to the scope of the claims, each numerical indication should at least be construed in light of the number of reported significant digits and by applying ordinary rounding techniques. Notwithstanding that the numerical ranges and values setting forth the broad scope of the invention are approximations, the numerical ranges and values set forth in the specific examples are reported as precisely as possible. Any numerical range or value, however, inherently contains certain errors necessarily resulting from the standard deviation found in their respective testing measurements. Recitation of numerical ranges of values herein is merely intended to serve as a shorthand method of referring individually to each separate numerical value falling within the range. Unless otherwise indicated herein, each individual value of a numerical range is incorporated into the present specification as if it were individually recited herein. Similarly, as used herein, unless indicated to the contrary, the term "substantially" is a term of degree intended to indicate an approximation of the characteristic, item, quantity, parameter, property, or term so qualified, encompassing a range that can be understood and construed by those of ordinary skill in the art, or at least encompassing a range of plus or minus ten percent above and below the value of the stated characteristic, item, quantity, parameter, property, or term.

Use of the terms "may" or "can" in reference to an embodiment or aspect of an embodiment also carries with it the alternative meaning of "may not" or "cannot." As such, if the present specification discloses that an embodiment or an aspect of an embodiment may be or can be included as part of the inventive subject matter, then the negative limitation or exclusionary proviso is also explicitly meant, meaning that an embodiment or an aspect of an embodiment may not be or cannot be included as part of the inventive subject matter. In a similar manner, use of the term "optionally" in reference to an embodiment or aspect of an embodiment means that such embodiment or aspect of the embodiment may be included as part of the inventive subject matter or may not be included as part of the inventive subject matter. Whether such a negative limitation or exclusionary proviso applies will be based on whether the negative limitation or exclusionary proviso is recited in the claimed subject matter.

The terms "a," "an," "the" and similar references used in the context of describing the present invention (especially in the context of the following claims) are to be construed to cover both the singular and the plural, unless otherwise indicated herein or clearly contradicted by context. Further, ordinal indicators—such as "first," "second," "third," etc.—for identified elements are used to distinguish between the elements, and do not indicate or imply a required or limited number of such elements, and do not indicate a particular position or order of such elements unless otherwise specifically stated. All methods described herein can be performed in any suitable order unless otherwise indicated herein or otherwise clearly contradicted by context. The use of any and all examples, or exemplary language (e.g., "such as") provided herein is intended merely to better illuminate the present invention and does not pose a limitation on the scope of the invention otherwise claimed. No language in the present specification should be construed as indicating any non-claimed element essential to the practice of the invention.

When used in the claims, whether as filed or added per amendment, the open-ended transitional term "comprising" (along with equivalent open-ended transitional phrases thereof such as "including," "containing" and "having") encompasses all the expressly recited elements, limitations, steps and/or features alone or in combination with un-recited subject matter; the named elements, limitations and/or features are essential, but other unnamed elements, limitations and/or features may be added and still form a construct within the scope of the claim. Specific embodiments disclosed herein may be further limited in the claims using the closed-ended transitional phrases "consisting of" or "consisting essentially of" in lieu of or as an amendment for "comprising." When used in the claims, whether as filed or added per amendment, the closed-ended transitional phrase "consisting of" excludes any element, limitation, step, or feature not expressly recited in the claims. The closed-ended transitional phrase "consisting essentially of" limits the scope of a claim to the expressly recited elements, limitations, steps and/or features and any other elements, limitations, steps and/or features that do not materially affect the basic and novel characteristic(s) of the claimed subject matter. Thus, the meaning of the open-ended transitional phrase "comprising" is being defined as encompassing all the specifically recited elements, limitations, steps and/or features as well as any optional, additional unspecified ones. The meaning of the closed-ended transitional phrase "consisting of" is being defined as only including those elements, limitations, steps and/or features specifically recited in the claim, whereas the meaning of the closed-ended transitional phrase "consisting essentially of" is being defined as only including those elements, limitations, steps and/or features specifically recited in the claim and those elements, limitations, steps and/or features that do not materially affect the basic and novel characteristic(s) of the claimed subject matter. Therefore, the open-ended transitional phrase "comprising" (along with equivalent open-ended transitional phrases thereof) includes within its meaning, as a limiting case, claimed subject matter specified by the closed-ended transitional phrases "consisting of" or "consisting essentially of." As such, embodiments described herein or so claimed with the phrase "comprising" are expressly or inherently unambiguously described, enabled and supported herein for the phrases "consisting essentially of" and "consisting of."

Any claims intended to be treated under 35 U.S.C. § 112(f) will begin with the words "means for," but use of the term "for" in any other context is not intended to invoke treatment under 35 U.S.C. § 112(f). Accordingly, Applicant reserves the right to pursue additional claims after filing this application, in either this application or in a continuing application.

It should be understood that any methods disclosed herein, along with the order in which the respective elements of any such method are performed, are purely exemplary. Depending on the implementation, they may be performed in any order or in parallel, unless indicated otherwise in the present disclosure.

All patents, patent publications, and other publications referenced and identified in the present specification are individually and expressly incorporated herein by reference in their entirety for the purpose of describing and disclosing, for example, the compositions and methodologies described in such publications that might be used in connection with the present invention. These publications are provided solely for their disclosure prior to the filing date of the present application. Nothing in this regard should be construed as an admission that the inventors are not entitled to antedate such disclosure by virtue of prior invention or for any other reason. All statements as to the date or representation as to the contents of these documents are based on the information available to the applicants and does not constitute any admission as to the correctness of the dates or contents of these documents.

While aspects of the invention have been described with reference to at least one exemplary embodiment, it is to be clearly understood by those skilled in the art that the invention is not limited thereto. Rather, the scope of the invention is to be interpreted only in conjunction with the appended claims and it is made clear, here, that the inventor(s) believe that the claimed subject matter is the invention.

What is claimed is:

1. A trophy apparatus, comprising:

a plurality of columns;

a bottom end of each column providing a bottom column cap threadably engaged therewith;

each bottom column cap providing a threaded opening through which a bottom cap bolt threadably extends;

an opposing top end of each column providing a top column cap threadably engaged therewith;

each top column cap providing a threaded opening through which a top cap bolt threadably extends;

a base piece providing a plurality of base column grooves positioned on a top surface thereof, each of the base column grooves sized and configured for receiving the bottom column cap of a corresponding one of the columns therewithin;

each of the base column grooves providing a threaded interface positioned and configured for threadably receiving the bottom cap bolt of a corresponding one of the columns when the bottom column cap of said corresponding one of the columns is inserted into said base column groove;

a lid piece providing a plurality of lid column grooves positioned on a bottom surface thereof, each of the lid column grooves sized and configured for receiving the top column cap of a corresponding one of the columns therewithin; and each of the lid column grooves providing a threaded interface positioned and configured for threadably receiving the top cap bolt of a corresponding one of the columns when the top column cap of said corresponding one of the columns is inserted into said lid column groove.

2. The trophy apparatus of claim 1, wherein an outer surface of each of the bottom column caps provides a threaded rim configured for threadable engagement with a corresponding threaded rim of an inner surface of the bottom end of a corresponding one of the columns.

3. The trophy apparatus of claim 1, wherein an outer surface of each of the top column caps provides a threaded rim configured for threadable engagement with a corresponding threaded rim of an inner surface of the top end of a corresponding one of the columns.

4. The trophy apparatus of claim 1, further comprising:

a plaque mount provided by the top surface of the base piece; and a plaque piece engageable with the plaque mount.

5. The trophy apparatus of claim 4, wherein:

a front surface of the plaque mount provides an at least one U-shaped prong; and a rear surface of the plaque piece provides an at least one inner track positioned and configured for slidably receiving the at least one prong of the plaque mount, thereby engaging the plaque piece with the plaque mount.

6. The trophy apparatus of claim 5, wherein:

the front surface of the plaque mount provides two or more U-shaped prongs positioned in a substantially parallel, spaced apart arrangement; and the rear surface of the plaque piece provides two or more inner tracks positioned in a substantially parallel, spaced apart arrangement.

7. The trophy apparatus of claim 1, wherein:

each of the bottom column caps and top column caps is circular in cross-section and cylindrical in shape; and each of the base column grooves and lid column grooves is circular in cross-section and cylindrical in shape.

8. The trophy apparatus of claim 1, wherein:

each of the base column grooves has a height that is substantially equal to a height of the bottom column cap of a corresponding one of the columns; and each of the lid column grooves has a height that is substantially equal to a height of the top column cap of a corresponding one of the columns.

9. The trophy apparatus of claim 1, wherein:

each of the base column grooves has a diameter that is relatively larger than a diameter of the bottom column cap of a corresponding one of the columns, such that each of the base column grooves may receive said corresponding bottom column cap therewithin; and each of the lid column grooves has a diameter that is relatively larger than a diameter of the top column cap of a corresponding one of the columns, such that each of the lid column grooves may receive said corresponding top column cap therewithin.

10. The trophy apparatus of claim 1, wherein the threaded interface of each of the lid column grooves extends from the bottom surface of the lid piece to an opposing top surface of the lid piece, such that the top cap bolt of the corresponding one of the columns is threadably inserted into the threaded interface from the top surface of the lid piece.

11. A trophy apparatus, comprising:

a plurality of columns;

a bottom end of each column providing a bottom column cap threadably engaged therewith;

each bottom column cap providing a threaded opening through which a bottom cap bolt threadably extends;

an opposing top end of each column providing a top column cap threadably engaged therewith;

each top column cap providing a threaded opening through which a top cap bolt threadably extends;

a base piece providing a plurality of base column grooves positioned on a top surface thereof, each of the base column grooves sized and configured for receiving the bottom column cap of a corresponding one of the columns therewithin;

each of the base column grooves providing a threaded interface positioned and configured for threadably receiving the bottom cap bolt of a corresponding one of the columns when the bottom column cap of said corresponding one of the columns is inserted into said base column groove;

a lid piece providing a plurality of lid column grooves positioned on a bottom surface thereof, each of the lid column grooves sized and configured for receiving the top column cap of a corresponding one of the columns therewithin;

each of the lid column grooves providing a threaded interface positioned and configured for threadably receiving the top cap bolt of a corresponding one of the columns when the top column cap of said corresponding one of the columns is inserted into said lid column groove;

a plaque mount engageable with the top surface of the base piece, a front surface of the plaque mount providing a plurality of U-shaped prongs positioned in a substantially parallel, spaced apart arrangement; and a plaque piece providing a plurality of inner tracks positioned in a substantially parallel, spaced apart arrangement on a rear surface thereof, the inner tracks configured for slidably receiving the U-shaped prongs of the plaque mount, thereby engaging the plaque piece with the plaque mount.

12. The trophy apparatus of claim 11, wherein an outer surface of each of the bottom column caps provides a threaded rim configured for threadable engagement with a corresponding threaded rim of an inner surface of the bottom end of a corresponding one of the columns.

13. The trophy apparatus of claim 11, wherein an outer surface of each of the top column caps provides a threaded rim configured for threadable engagement with a corresponding threaded rim of an inner surface of the top end of a corresponding one of the columns.

14. The trophy apparatus of claim 13, wherein:

each of the bottom column caps and top column caps is circular in cross-section and cylindrical in shape; and each of the base column grooves and lid column grooves is circular in cross-section and cylindrical in shape.

15. The trophy apparatus of claim 13, wherein:

each of the base column grooves has a height that is substantially equal to a height of the bottom column cap of a corresponding one of the columns; and each of the lid column grooves has a height that is substantially equal to a height of the top column cap of a corresponding one of the columns.

16. The trophy apparatus of claim 13, wherein:

each of the base column grooves has a diameter that is relatively larger than a diameter of the bottom column cap of a corresponding one of the columns, such that each of the base column grooves may receive said corresponding bottom column cap therewithin; and each of the lid column grooves has a diameter that is relatively larger than a diameter of the top column cap of a corresponding one of the columns, such that each of the lid column grooves may receive said corresponding top column cap therewithin.

17. The trophy apparatus of claim 13, wherein the threaded interface of each of the lid column grooves extends from the bottom surface of the lid piece to an opposing top surface of the lid piece, such that the top cap bolt of the corresponding one of the columns is threadably inserted into the threaded interface from the top surface of the lid piece.

* * * * *